United States Patent [19]

Eskeli

[11] 4,106,304

[45] Aug. 15, 1978

[54] THERMODYNAMIC COMPRESSOR

[76] Inventor: Michael Eskeli, 7994-41 Locke Lee, Houston, Tex. 77042

[21] Appl. No.: 724,407

[22] Filed: Sep. 17, 1976

Related U.S. Application Data

[63] Continuation-in-part of Ser. No. 708,863, Jul. 26, 1976, Ser. No. 546,912, Feb. 4, 1976, abandoned, and Ser. No. 600,312, Jul. 30, 1975, Pat. No. 3,986,361.

[51] Int. Cl.[2] ..... F25B 3/00

[52] U.S. Cl. ..... 62/88; 60/650; 62/402; 123/220; 165/DIG. 12; 418/86

[58] Field of Search ..... 62/401, 86, 88, 402; 60/650, 682; 418/86; 417/243; 415/178; 165/DIG. 12

[56] References Cited

U.S. PATENT DOCUMENTS

| | | | |
|---|---|---|---|
| 1,893,171 | 1/1933 | Kägi | 62/401 |
| 2,526,103 | 10/1950 | Wood | 62/401 |
| 2,714,289 | 8/1955 | Hofmann | 60/650 |
| 2,729,073 | 1/1956 | Nielsen et al. | 62/402 |
| 2,754,660 | 7/1956 | Morrison | 62/401 |
| 2,959,025 | 11/1960 | Morrison | 62/401 |
| 3,319,611 | 5/1967 | Terazawa | 123/8.01 |
| 3,327,495 | 6/1967 | Ergenc | 62/401 |
| 3,686,893 | 8/1972 | Edwards | 62/401 |
| 3,823,559 | 7/1974 | Foret | 62/401 |

*Primary Examiner*—Charles J. Myhre
*Assistant Examiner*—Sheldon Richter

[57] ABSTRACT

A method and apparatus for the compression of compressible fluids wherein a fluid is first compressed within a constant volume with addition of heat, and then further compressed in a compressor means increasing the fluid pressure and temperature. After compression, the fluid is passed into a heat exchanger for heat removal, with the heat so removed usually being used as the heat being added into the fluid in the initial step. After passing through the heat exchanger, the fluid leaves the process. Various types equipment may be used, including vane, piston, screw or other positive displacement type apparatus. In an alternate arrangement, heat may also be removed during the compression in the compressor means. Also, work may be extracted from the fluid after leaving the heat exchanger heat removal.

4 Claims, 5 Drawing Figures

THERMODYNAMIC COMPRESSOR

CROSS REFERENCES TO RELATED APPLICATIONS

This application is a continuation-in-part application of "Thermodynamic Compressor", Ser. No.708,863, filed July 26, 1976, and "Power Generator", Ser. No.546,912, filed February 4, 1976, now abandoned and "Turbine with Regeneration", Ser. No.600,312, filed July 30, 1975, now U.S. Pat. No. 3,986,361.

BACKGROUND OF THE INVENTION

This invention relates generally to apparatus for compressing gases and other compressible fluids, wherein the fluid is heated first essentially at constant volume, and then work is added to the fluid compressing it, and after that heat is removed, with such removed heat being usually used to heat the fluid.

SUMMARY OF THE INVENTION

The object of this invention is to provide a means for compressing gases with reduced work input, by doing part of the gas compression at constant volume, with heat addition, thus increasing the gas pressure without shaft work. The heat required to be added is obtained regeneratively from the same fluid. Alternately, external heat may be used. Also, some heat at high temperature may be removed, and passed to other uses.

DESCRIPTION OF PREFERRED EMBODIMENTS

The systems shown in the several Figures use all positive displacement equipment for compressing means, and use a stationary heat exchanger to remove heat from the fluid after compression; this heat exchanger is similar to the well known after cooler used with commercial air compressors. However, instead of wasting the heat removed from the working fluid after compression, the heat is used to partially compress the working fluid by adding such heat into the working fluid at constant volume before actual mechanical compression. Thus, thermodynamic methods are used to pressurize the working fluid in part, avoiding the addition of work from external sources for that part of the compression.

In normal practice in the past, it has been a cardinal rule that for minimum work input one should have a working fluid as cold as possible at start of compression. However, one can reduce work input for the compression also by heating, if such heating is done in a confined space at constant volume, so that the fluid pressure in the volume is increased without work. In the arrangement used here, work is added to the working fluid after such heat addition; such work addition also increases the working fluid temperature even further, and it is this work addition which maintains the process, and maintains the working fluid temperature at a predetermined level. Theoretically, one thus can set the temperature at start of mechanical compression as high as desired, and for best results, a high temperature, to the upper limits of what the materials of the compressor can stand, are desirable. At the same time, the actual work input to the working fluid by the mechanical compressor, can be almost as low as desired; typically, the work input to the working fluid should be perhaps 5 to 10 BTU/lb, and such work input is only in such instant intended to maintain the working fluid temperature, and not intended to compress the working fluid except in a minor way.

Figure 1:
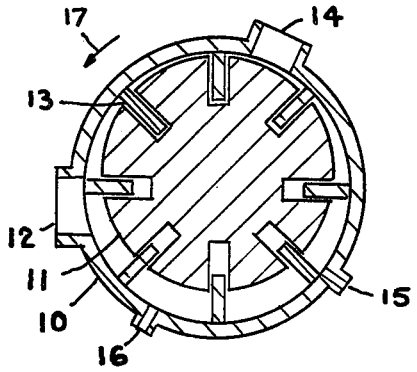
In FIG. 1, a vane type unit is shown in detail, illustrating working fluid entry and exit opening approximate locations, and also heat transfer fluid entry and exit openings.

The process can be further explained with the help of the several Figures. In FIG. 1, a vane unit is shown, which is a normal vane unit with ports provided in suitable places for the entry and exit of the working fluid, and the entry and exit of a heat transfer fluid needed for heat addition to working fluid. 10 is casing, supporting and housing rotor 11, and vanes 13. 12 is working fluid entry, and 14 is working fluid exit. 15 is heat transfer fluid exit and 16 is heat transfer fluid entry, 17 is arrow.

Figure 2:
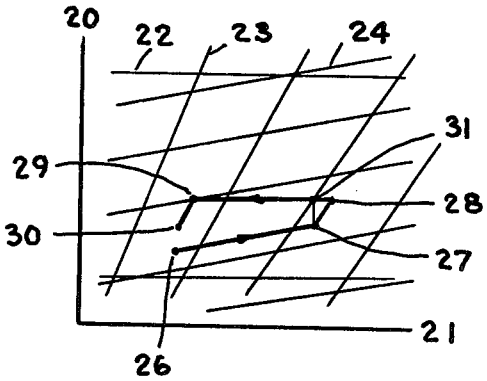
In FIG. 2, a typical pressure-internal energy diagram for the compression process is shown.

In FIG. 2, a pressure-internal energy or enthalpy diagram is shown for a typical working fluid, with a work cycle for the compression process illustrated thereon. 20 is pressure line, 21 is internal energy or enthalpy line, 22 is constant pressure line, 23 is constant entropy line, 24 is constant volume line, line 26–27 is constant volume heat addition, 27–28 is isentropic compression, 28–29 is constant pressure heat removal, and 29–30 is an optical work removal from the working fluid, with point 30 located as desired at the desired pressure, and line 27–31 is a constant temperature compression process, which may be used alternately with the isentropic compression. Line 28–31 may be also used to indicate high temperature heat removal, if such is used, with the heat being passed to a use external to this process.

Figure 3:
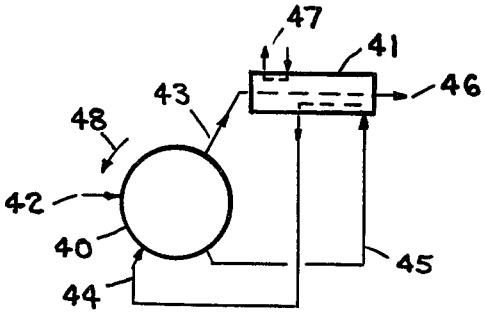
In FIG. 3, a typical system using the unit of FIG. 1, is shown.

In FIG. 3, a system using the vane unit shown in FIG. 1 is shown, to work in accordance to the work cycle shown in FIG. 2. The rotation is indicated by 48, 42 is working fluid entry, 40 is vane unit, 44 and 45 are heat transfer fluid conduits, 46 is working fluid exit, 41 is heat exchanger, 47 is high temperature removal heat transfer fluid conduits, 43 is working fluid exit from vane unit.

Figure 4:
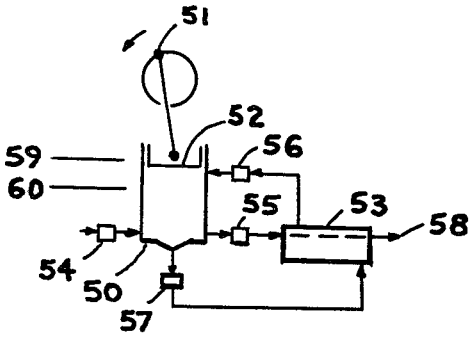
In FIG. 4, a typical system using a piston and cylinder arrangement is shown, employing a work cycle as shown in FIG. 2.

In FIG. 4, a system is shown using a piston and cylinder arrangement. 50 is cylinder, 51 is crank, 52 is piston, working fluid enters via valve 54 and leaves via valve 55 and passes into heat exchanger 53 and exits via 58. Heat transfer fluid enters via valve 56 when piston is in position shown, which is also indicated by numeral 59. When piston is in position shown by line 60, heat transfer fluid leaves via valve 57, and passes through heat exchanger 53 to valve 56. The remaining compression of working fluid from line 60 to bottom end of piston travel, is the compression indicated by line 27–28 in FIG. 2; such piston travel also includes working fluid delivery out from the cylinder. The cylinder is then filled via valve 54 during the piston travel from cylinder bottom to cylinder top.

Figure 5:
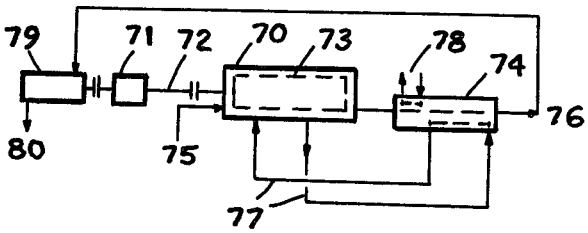
In FIG. 5, a typical system using a screw type compressor is shown.

In FIG. 5, a unit using a screw type compressor is shown. 70 is screw unit casing and 73 is screw, connected to drive 71 via shaft 72. Working fluid enters via 75, and during its passage through screw unit is heated by heating fluid passing through conduits 77, the working fluid then passes through heat exchanger 74 where heat is first removed to fluid in conduits 78 and then to heat transfer fluid in conduits 77, and after this, the working fluid may be discharged, or be passed into an expander 79, and then discharged via 80. The work extraction in the expander 79 corresponds to the work removal shown by line 29–30 in FIG. 2.

In operation, and referring to the system of FIG. 3, the compressor rotor is caused to rotate. The working fluid enters and fills the rotor cavity and then the vanes seal the packet of working fluid from the entry opening. The working fluid is then heated, in the approximately constant volume, by injecting a heat transfer fluid into the space, usually through suitable spray nozzles, so as to assure good mixing of the working fluid and the heat transfer fluid. The heat transfer fluid, in many instances may be light oil, providing also lubrications for the vanes. The heat transfer fluid is then removed before starting of mechanical compression, and the working fluid is compressed, with accompanying temperature increase, and then discharged to a stationary heat exchanger where the heat is removed from the working fluid and transferred into the heat transfer fluid to be used to heat the working fluid before mechanical compression. Heat can be also removed during mechanical compression by injecting a second heat transfer fluid into the rotor cavity and then removing it after warming of the second heat transfer fluid; this is not shown in drawings for the apparatus, but is indicated in FIG. 2, line 27–31.

The operation of the systems shown in FIGS. 4 and 5 is similar to the operation of the system of FIG. 3.

The applications for this system and method are in the compression of various gases with low energy consumption. The systems can be used to provide compression stages for various other apparatus, such as gas turbines, heat pumps and the like. Further, the system shown in the several figures may be made to include several stages, so that after the working fluid leaves at point 29, of FIG. 2, it again enters another system at its point 26, and undergoes a similar process gaining again in pressure.

The heat addition at constant volume can be accomplished using other means, in place of the heat transfer fluid being used herein, to add the heat. One can use jackets around the cylinders, for example, as is done in commercially available units. Similarly, jackets can be provided for the vane or screw units. One can also use heat exchangers placed within the mechanical compressor to be in heat exchange relationship with the confined working fluid, to provide heat addition at constant volume. All these devices are known to people in the trade, and need not be explained further herein; the method in each instance is the same, and follows approximately the process shown in FIG. 2.

The heat removal at high temperature, such as through conduits 47 in FIG. 3, can be used to provide a heat pump using this process. If the units main purpose is to be a heat pump, then line 29–30 may be extended so that point 30 is at the same pressure with point 26. Such system then may be similar to that shown in FIG. 5, with the work from expander 79 fed back to system via the connecting shaft.

The apparatus of FIG. 1 and 3 were the subject of U.S. Pat. No. 3,972,194, by this applicant, in slightly different form. The apparatus of FIG. 4 and FIG. 5 are shown also in copending patent applications, Ser. Nos. 546,912 and 674,398, in slightly different form.

Other types of equipment can be used in addition to the types shown. Rotary piston, the wankel type rotary, and various gear types and other positive displacement type devices can be used. They may use the heat transfer fluid, or have jackets, or have heat exchangers. However, the compression process, as shown in FIG. 2, with constant volume heat addition, followed with heat addition either by using a compressor, or using external heat, is required, as disclosed in this invention.

In the drawings, the heat removal for external use, such as conduits 47 in FIG. 3, are shown as a part of the heat exchanger 41. A separate heat exchanger may be provided to contain lines 47 if desired.

In FIG. 4, the cylinder is shown with the cylinder head downward, and this is to provide better drainage of the heat transfer fluid. The cylinder may be set at any suitable orientation.

It should be also obvious that the working fluid being discharged by the compressor could be used directly as the heating fluid for the heat addition to the working fluid upstream of mechanical compression. Where the compressing unit is jacketed, or provided with suitable heat exchanger means this can be done. The same method, embodied in the work cycle of FIG. 2, still applies, even though the heat transfer fluid is not used. The heat transfer fluid used in the apparatus shown in the drawings, is merely a means for transferring the heat; other means for transferring the heat may be also used, without departing from the method shown in FIG. 2.

I claim:

1. A method of compressing a compressible working fluid comprising:

a. confining said working fluid in an approximately constant volume and simultaneously adding heat into said working fluid increasing the temperature of said working fluid, and increasing the pressure of said working fluid;

b. elevating the pressure of said working fluid by adding work into subsequently said working fluid in a mechanical compressing means;

c. removing heat from said working fluid and transferring at least a portion of such heat into said working fluid upstream of said mechanical compressing means.

2. The method of claim 1 comprising the additional step of extraxting work from said working fluid downstream of said heat removal.

3. The method of claim 1 comprising the additional step of removing heat from said working fluid downstream of said mechanical compressing means, and passing such heat out of the compressing system.

4. The method of claim 1 comprising the additional step of providing cooling for said working fluid during compression within said mechanical compressing means.

* * * * *